US006119811A

United States Patent [19]

Tsung-Ping

[11] Patent Number: 6,119,811

[45] Date of Patent: Sep. 19, 2000

[54] MULTIPLE FUNCTIONAL, FOLDABLE, AND PORTABLE LADDER

[76] Inventor: Lin Tsung-Ping, No. 13, Lane 47, Sec. 1, San-Ho Rd., Sanchung City, Taipei Hsien, Taiwan

[21] Appl. No.: 09/285,880

[22] Filed: Apr. 7, 1999

[51] Int. Cl.[7] ..... E06C 1/36

[52] U.S. Cl. ..... 182/164; 182/159; 182/206

[58] Field of Search ..... 182/164, 163, 182/159, 156, 206

[56] References Cited

U.S. PATENT DOCUMENTS 4,231,449 11/1980 Laurita ..... 182/164

*Primary Examiner*—Alvin Chin-Shue

*Attorney, Agent, or Firm*—Dougherty & Troxell

[57] ABSTRACT

A multiple functional, foldable, and portable ladder comprises a plurality of ladder units 5, wherein the ladder unit has a supporting rod on the two sides thereof. Each supporting rod is foldable so that the ladder is expandable for upstanding or foldable so as to be carried and stored and be used in emergency. Thus the ladder is convenient in application and storage. Two supporting rods between two adjacent ladder units 5 are pivotally connected by pivotal shafts, and two ends of each pedal are installed with respective control seats. A pivotal shaft and a movable buckling rod are installed within the control seat. Thereby, when the ladder is expanded, the supporting rod of the ladder unit is assembled by the control seat, during folding, the supporting rods are folded after the buckling rods has been displaced.

4 Claims, 9 Drawing Sheets

MULTIPLE FUNCTIONAL, FOLDABLE, AND PORTABLE LADDER

FIELD OF THE INVENTION

The present invention relates to a multiple functional, foldable, and portable ladder, wherein the supporting rods on the two sides of the ladder unit are pivotally connected. The two ends of each step at the ladder unit have respective control means for buckling and releasing the ladder rungs. When the ladder is folded, the pivotal connection of the supporting rod is released easily so that the supporting rod can be folded easily. Therefore, the length of the ladder is reduced to a minimum value so as to be carried and stored conveniently.

DESCRIPTION OF THE PRIOR ART

Ladders are widely used in daily life. However, the early ladders made of wood can not be folded, and thus it is inconvenient to carry and store them. Especially for a long ladder, this will induce a serious problem. Meanwhile, the weight of early ladders is increased. A long ladder must be carried by two people. If a ladder is necessary to be used for a long time, this is an obstacle. Wooden ladders also have the function of rescue in emergency.

Later, aluminum ladders were invented; they are lightly weighted, thus the user may use them conveniently. The aluminum ladder was further improved by manufacturers. Thus, ladders with articulations were invented, and many kinds of such ladders have been allowed with patents in Taiwan. However, these kinds of ladders are folded according to finite positions of the articulations; therefore, after being folded, the ladder still has a finite length. Thus, it is inconvenient to store and carry such ladders. Especially, these kinds of ladders can still not be used in rescue operations.

In order to overcome the inconvenience of the prior art ladder, Taiwan Patent No. 79209363 discloses a "foldable rod shaped ladder", which is a brand new structure. When the ladder is not being used, it can be folded as a rod. Thus, the ladder is easy to store and carry. However, the aluminum ladder is confined in its length. If the ladder is too long, the problem in the prior art still occurs. Thus, it is necessary to be further improved.

Another, Taiwan Patent No. 7203867, discloses a "simple structure foldable ladder". It is another kind of aluminum ladder. In the ladder, a plurality of standing rods having a U shape cross section and a plurality of transversal rods having a rectangular shape are used. These rods are serially connected by movable plates and rivets. They can be separated by male latches and female buckling pieces. As a result, the foldable ladder can be expanded for using and folded for storage and carrying. Although this is a skillful design, it has never been seen in the market, since the structure is too weak due to the connection of rivets and movable plates. If the ladder is expanded, this structure will form a weak point in the structure, and if the load is too great, the weak point is probably deformed or even destroyed. Thus, this is dangerous in actual use, particularly as a rescue ladder.

SUMMARY OF THE INVENTION

Accordingly, the object of the present invention is to provide a multiple functional, foldable, and portable ladder comprising a plurality of ladder units. Each ladder unit has a supporting rod on the two sides thereof. Each supporting rod is foldable so that the ladder is expandable for upstanding or foldable so as to be carried or stored and be used in an emergency. Thus the ladder is convenient in application and storage. The ladder of the invention is characterized in that two supporting rods between two adjacent ladder units are pivotally connected by pivotal shafts, and two ends of each step are provided with respective control means. A pivotal shaft and a movable buckling rod are provided within each control means. Thus, when the ladder is expanded, the supporting rod of each ladder unit is fixed by a control means. During folding, the supporting rods are folded after the buckling rods have been displaced.

Another object of the present invention is to provide a multiple functional, foldable, and portable ladder, wherein two sides of each supporting rod are provided with respective assembling tubes for assembling a pivotal block. Therefore, by the pivotal block and the pivotal shaft, the ladder of the present invention has a preferred structure.

A further object of the present invention is to provide a multiple functional, foldable and portable ladder. Each control means is provided with a pivotal shaft. This pivotal shaft may pass through the pivotal hole in the pivotal block at the upper and lower supporting rod for providing a pivotal connection. Further, a buckling rod is formed in each control means, which may be buckled in the buckling groove of the pivotal block for achieving the function of fixing by buckling.

According to the multiple functional, foldable and portable ladder of the present invention, each control means is further provided with a long hole for receiving the buckling rod, which may match with a regulating ring, a regulating plate, and a regulating spring so as to provide a proper restoring force and thus retain the control means in a buckled position.

According to the multiple functional, foldable and portable ladder, the outer side of each control means is provided with a control piece for connection to a movable plate. The plate moves the control piece so as to cause a displacement of the buckling rod. Therefore, the buckling rod is released.

The present invention will be better understood and its numerous objects and advantages will become apparent to those skilled in the art by reference to the following drawings.

DETAILED DESCRIPTION OF THE PREFERRED EMBODIMENT

Figure 1:
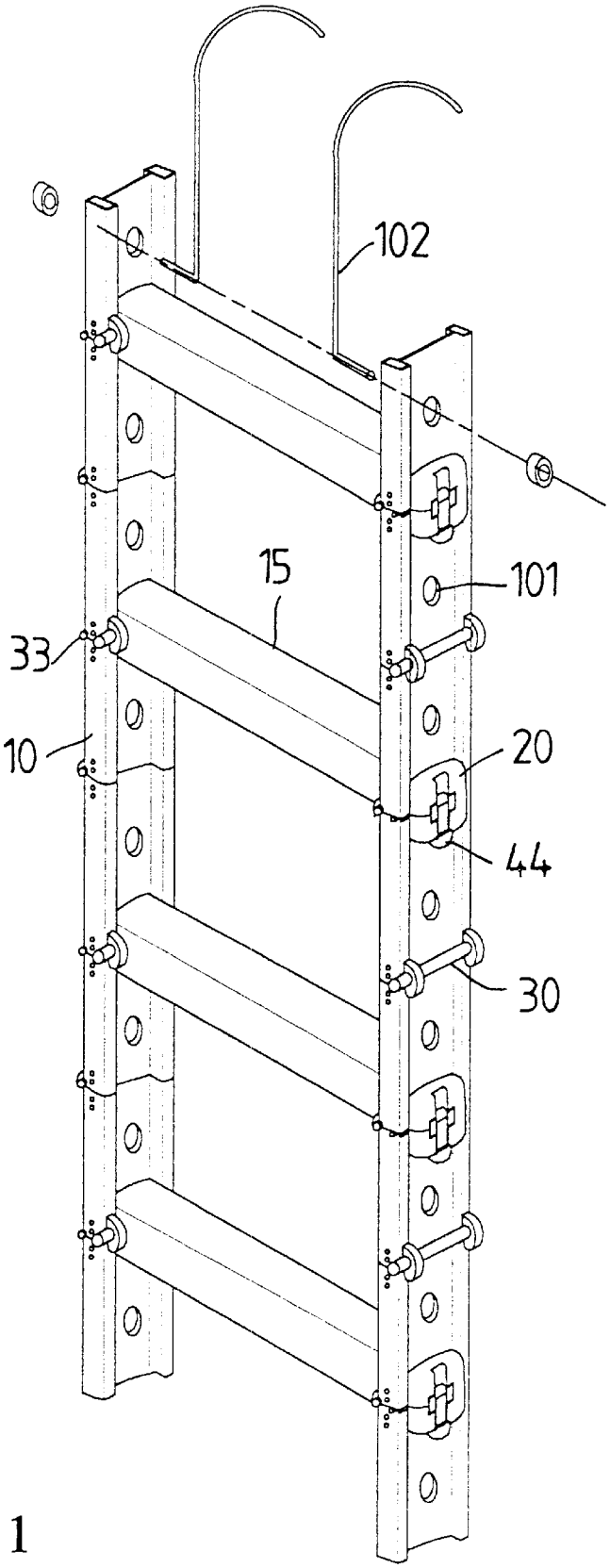
FIG. 1 is a perspective view of the preferred embodiment of the present invention.
Figure 2:
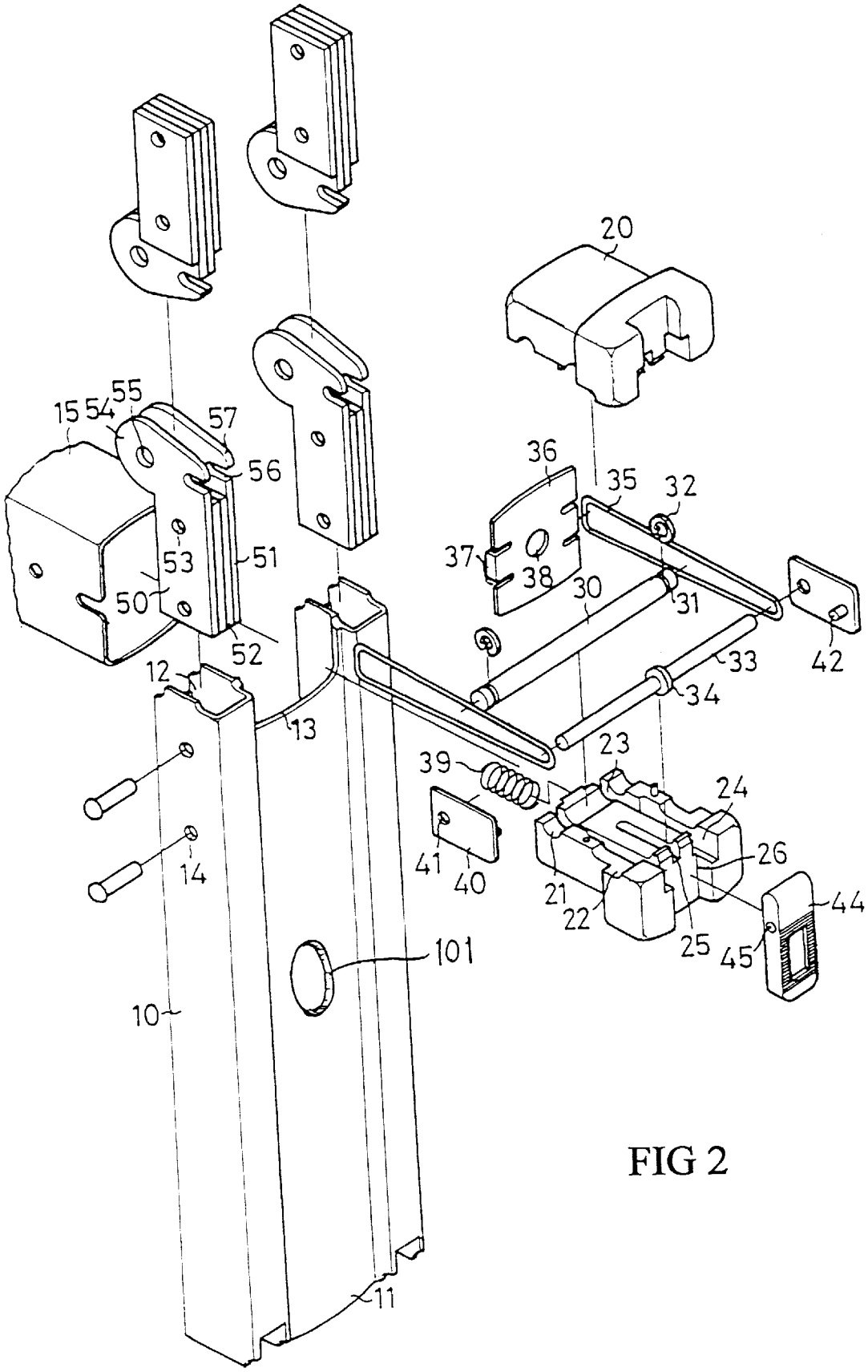
FIG. 2 is an exploded schematic view of the components of the control means in the preferred embodiment of the present invention.
Figure 9:
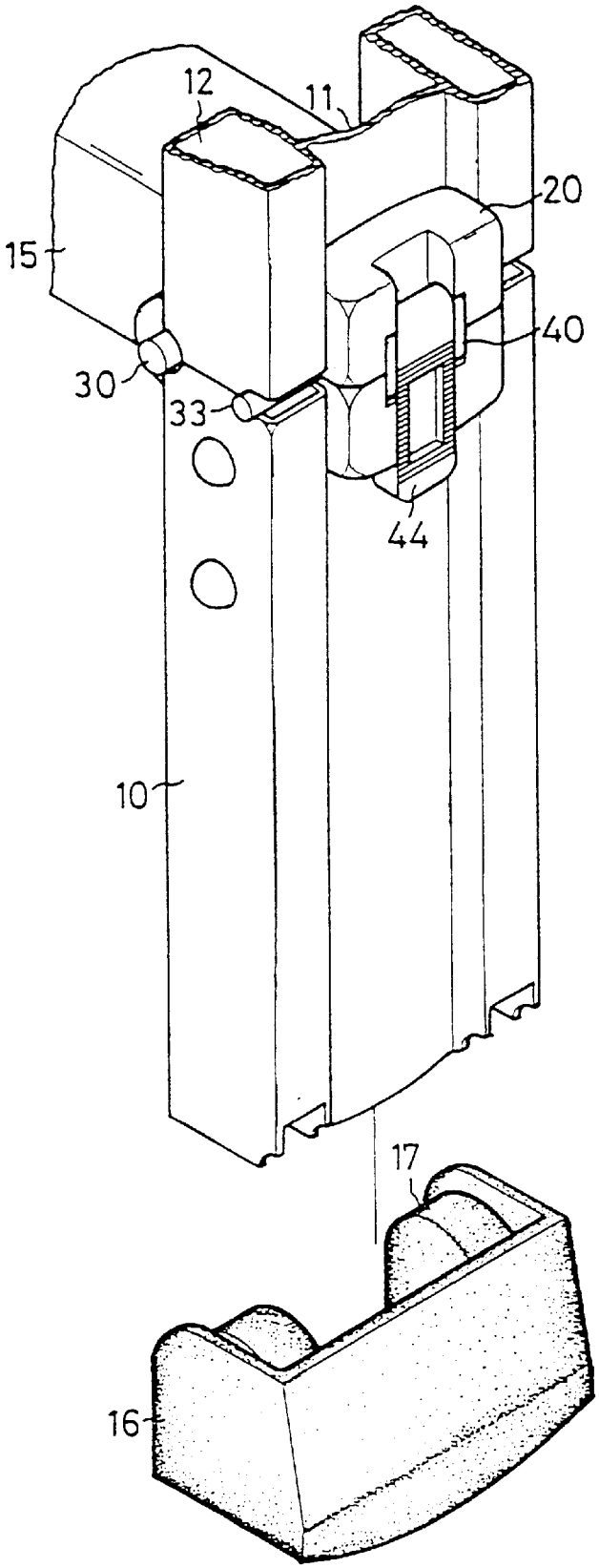
FIG. 9 shows a part of the leg pad in the preferred embodiment according to the present invention.

As shown in FIG. 1, a schematic perspective view according to the present invention is illustrated. In order that the present invention may be easily understood, in the embodiment of the present invention, a single surface ladder is described; however, this example is not used to confine the present invention. The present invention can also be used in other kinds of ladders, such as an A type rescue ladder or an aluminum ladder. All such modifications are within the scope and spirit of the present invention. As shown in FIG. 1, the ladder according to the present invention is formed by a plurality of ladder units, which are formed primarily by pivotally connected a supporting rod (10) with a step (15). The supporting rod (10) is pivotally connected with each of two adjacent steps (15) by a pivotal axis (30). Each end of the step (15) is pivotally connected to the interior of the supporting rod (10). A control means (20) is installed on the outer side of the supporting rod (10) to connect two adjacent supporting rods (10). A movable plate (44) is provided on the control means (20). The upper and lower ends of the supporting rod (10) are provided with respective leg pads (16) as shown in FIG. 9. Each supporting rod (10) is provided with a through hole (101). It can be seen in FIG. 9 that each supporting rod (10) according to the present invention is formed by a connecting plate (11) and assembling tubes (12) on the two sides thereof. As shown in FIG. 2, positioning notch (13) is formed on one edge of the connecting plate (11), which receives one end of the step (15). A rivet connecting hole (14) is formed on the lateral side of the assembling tube (12).

Figure 3:
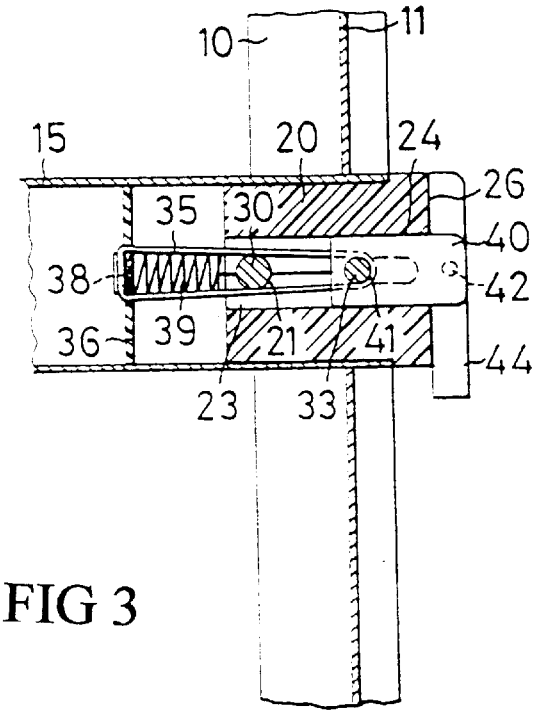
FIGS. 3 and 4 are assembled cross sectional views showing the control means of the preferred embodiment according to the present invention.
Figure 4:
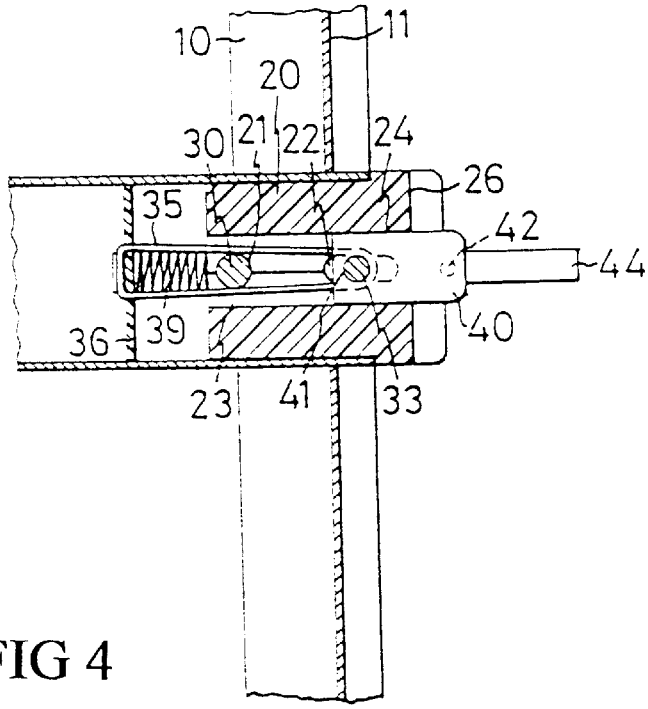

Referring to FIGS. 3 and 4, control means (20) is formed by an upper and a symmetrical lower block. After the two blocks are connected, they are assembled so as to be received in the end of the step (15) having a tube structure. Each control means (20) is provided with a transversal round axial hole (21) and a long hole (22). The two ends of the control means (20) are longitudinally provided with regulating grooves (23). Wider control grooves (24) are formed on the two outer sides of the control means (20) of the regulating grooves (23). A movable groove (26) is provided on the outer surface of the control means (20).

Returning to FIG. 2, a pivotal connecting shaft (30) is provided within the round axial hole (21) of the control means (20). Two ends of the pivotal connecting shaft (30) are provided with respective buckling grooves (31). A C ring (32) serves to pivotally connect the supporting rods (10) and steps (15). A buckling rod (33) is installed in the long hole (22) of the control means (20). The center of the buckling rod (33) is provided with a confining convex ring (34). When the buckling rod is assembled to the long hole (22) of the control means (20), the convex ring (34) may be buckled to a confining groove (25) so that the buckling rod will not extend out from the long hole (22) of the control means (20). A regulating ring (35) is installed in the regulating grooves (23) of the control means (20). The outer end of the regulating ring (35) is enclosed by buckling rod (33), while the inner end of the regulating ring (35) is protruded out of the inner end of the regulating groove (23) of the control means (20) to combine with respective regulating plates (36) in the inner side of the control means (20). The sides of the regulating plate (36) are provided with respective slots (37) for connection to the regulating ring (35). A concave positioning groove (38) is provided on the outer lateral surface. The regulating plate (36) has been assembled to the inner side of the control means (20). A regulating spring (39) is provided between the inner surfaces of the regulating plate (36) and the control means (20). The control groove (24) of the control means (20) is provided with a control piece (40). A rod hole (41) for buckling with the buckling rod (33) is provided in the control piece (40) and a pillar (42) is formed at the outer end of the control piece (40). The pillar serves to be pivotally connected to the pillar hole (45) on the movable plate (44).

The end portions of the assembling tube (12) on the two sides of the rescue ladder units (10) according to the present invention are provided with respective pivotal blocks (50) which are formed by two outer steel pieces (51) and two inner pieces (52). Each pivotal block (50) is provided with rivet hole (53) matching with rivet hole (14) of the supporting rod (10). Thereby, the pivotal block (50) can be steadily installed on the end portion of the assembling tube (12) of the supporting rod (10) by a rivet. The end portions of the two outer steel pieces (51) and the two inner steel pieces (52) are extended with respective pivotal ends (54). Each pivotal end (54) is installed with a pivotal hole (55) for receiving the pivotal shaft (30). In addition, a buckling groove (56) for receiving the buckling rod (33) is installed on one side of each pivotal end (54). The pivotal block (50) on the side of the buckling groove (56) is formed with a cambered edge.

As shown in FIGS. 3 and 4, the schematic cross sectional view of the control means (20) according to the present invention is illustrated. When the control means (20) has been assembled, the inner side thereof is inserted into the end portion of the step (15) having a tubular structure. The pivotal shaft (30) is inserted into the round shaft hole (21) and the buckling rod (33) passes through the long hole (22) to be installed on the outer end of the regulating ring (35) in the regulating grooves (23) so as to enclose the buckling rod (33). The middle portion of the regulating ring (35) passes over the pivotal shaft (30), while the inner end of the regulating ring (35) will protrude out of the regulating groove (23) to combine with the regulating plate (36). A regulating spring (39) is provided between the inner surfaces of the regulating plate (36) and the control means (20) so as to retain the buckling rod (33) in the inner position of the long hole (22) as shown in FIG. 4. A control piece (40) passes around the buckling rod (33) and is pivotally installed on the side of the movable plate (44) by the pillar (42) so that the movable plate (44) is connected to the movable groove (26) on the inner surface of the control seat (20).

When a user moves the movable plate (44), the control piece (40) will pull outwards so that the buckling rod (33) in the long hole (22) of the control means (20) will be pulled outwards. Then, as shown in FIG. 4, the regulating plate (36) will move outwards by the regulating ring (35) so that the regulating spring is compressed.

Figure 5:
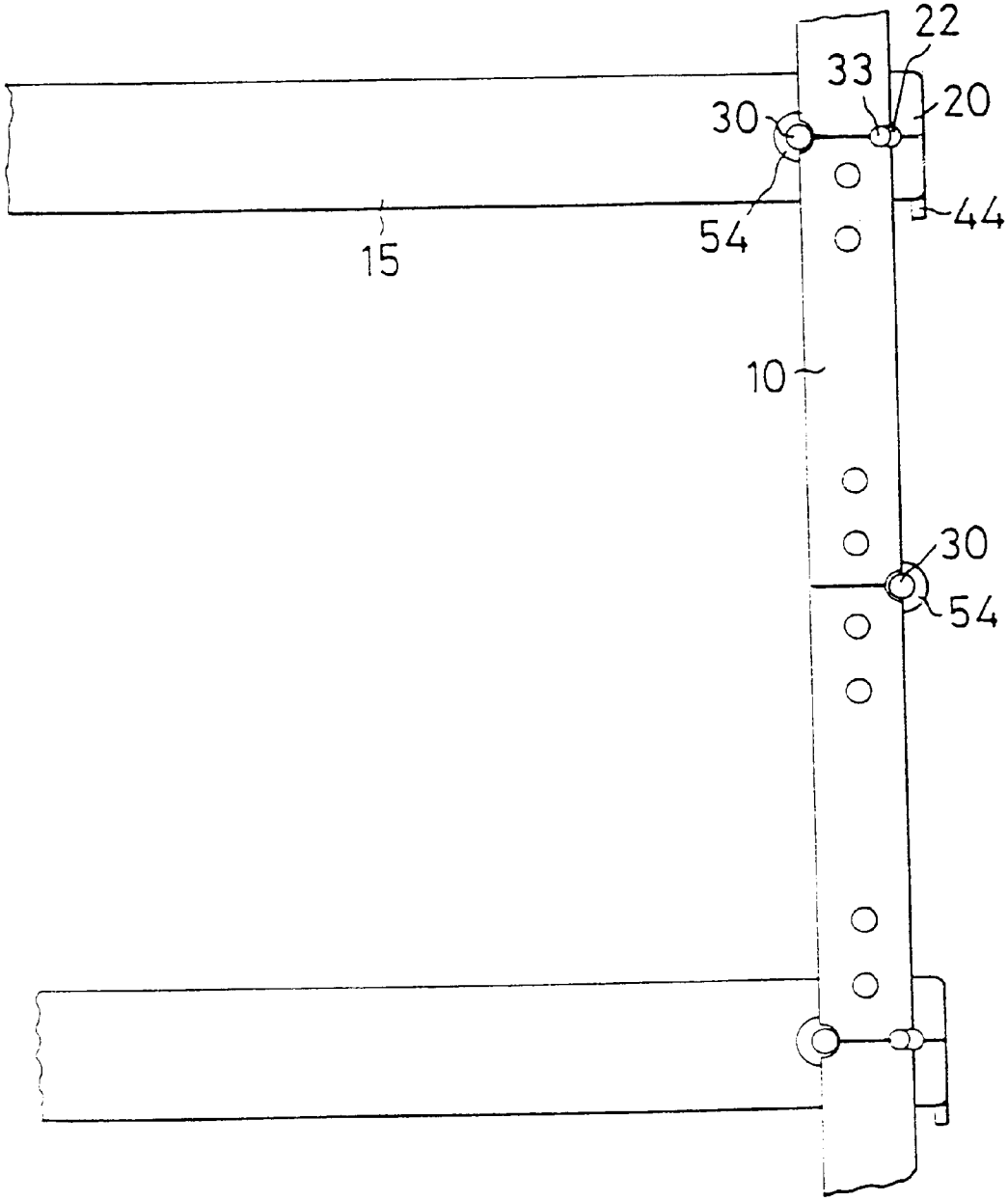
FIGS. 5—7 are side views showing the folding operation of the ladder according to the present invention.
Figure 6:
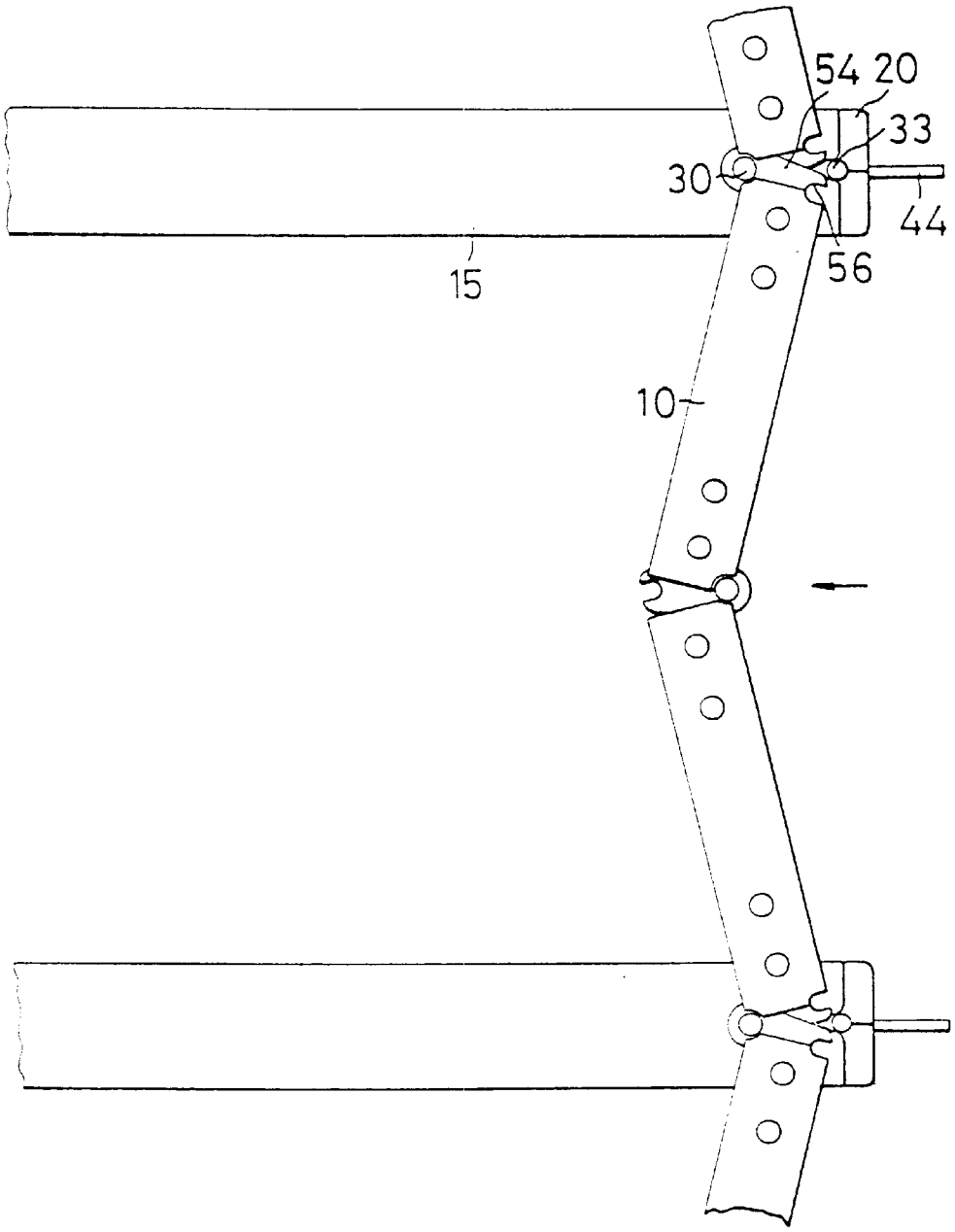
Figure 8:
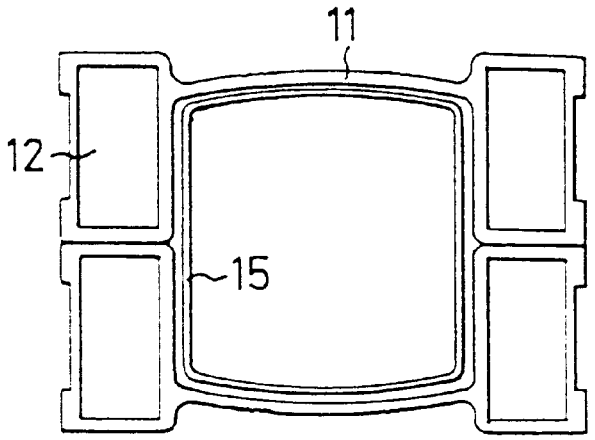
FIG. 8 is a schematic cross sectional view showing the ladder folded according to the preferred embodiment of the present invention.
Figure 7:
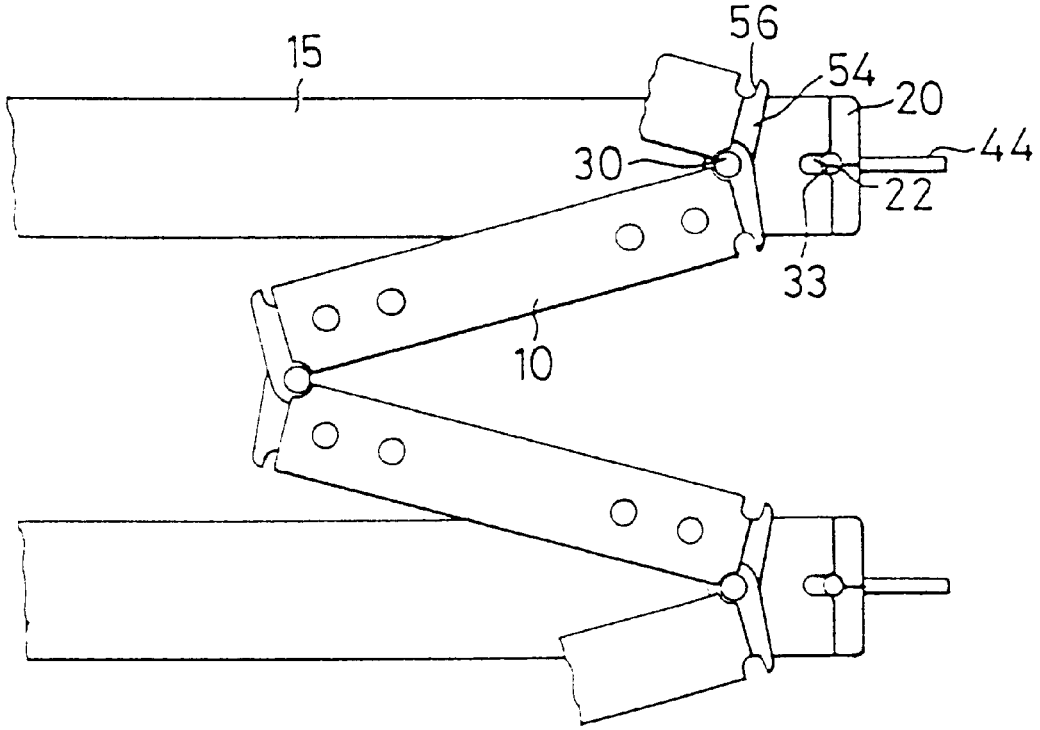

Referring to FIGS. 5–7, the flow chart for folding the ladder units of the present invention is illustrated. When the ladder of the present invention is expanded, as shown in FIG. 5, the pivotal shaft (30) serves to pivotally connect the pivotal blocks (50) (shown in FIG. 2) on the end portions of the two supporting rods (10), and the buckling rod (33) is buckled within the buckling groove (56) of the two pivotal blocks (50) so as to retain the expanded position. When the user desires to fold the ladder of the present invention, the movable plate (44) may be moved outwards, and the buckling rod (33) will separate from the buckling groove (56) of the pivotal block (50). The supporting rods (10) may then be folded. In folding, the pivotal shaft (30) of the supporting rod (10) between the two steps (15) can be pushed inwards as indicated in FIG. 6. Thus, each supporting rod (1) is overlapped to the inner side. After the ladder has been folded, the relative position between the supporting rod (10) and the step (15) is shown in FIG. 8. Thereby, the cambered connecting plate (11) between the supporting rods (10) is exactlly adhered to the outer surface of the step (15). As a result, the overall volume of the ladder is reduced to a minimum value so that the user may carry or store it conveniently.

Figure 11:
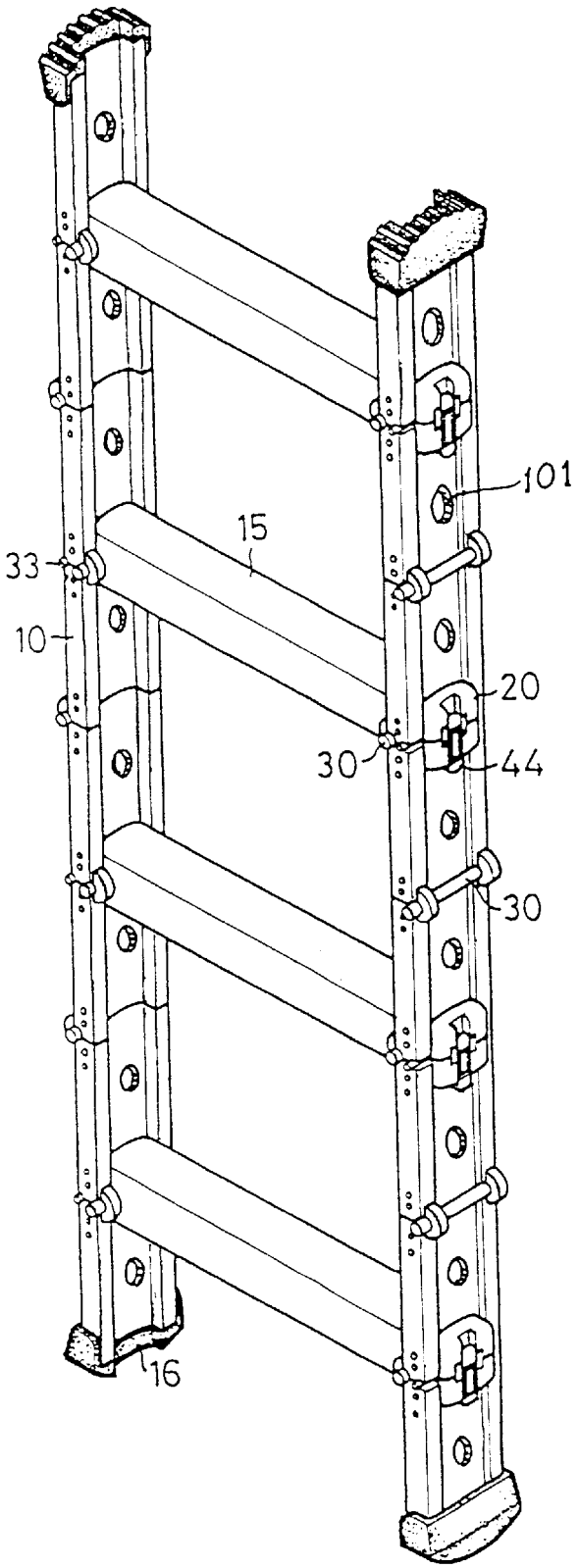
FIG. 11 is a schematic view showing the present invention as used during building a house.

With reference to FIG. 9, the exploded schematic view of the leg pad (16) according to the preferred embodiment of the present invention is illustrated. Two assembling blocks (17) are aligned with assembling tubes (12) of the supporting rod (10). During assembly, it is only necessary to insert the assembling block (17) into the distal end of the assembling tube (12) of the supporting rod (10). It is relatively convenient to assemble. Of course, it can be updated easily. When the two ends of the ladder are fitted with assembling blocks, the ladder can be used as shown in FIG. 11, for example, for construction purposes.

As is clear from the above description, in folding the structure of the present invention, it is only necessary to move the movable plate (44) outwards, to pull the buckling rod (33) outwards from the long hole (22) of the control means (20) and through the control means (20) so as to release from the buckling groove (56) on the pivotal block (50). Thus, the supporting rod (10) can be folded. The operation of the present invention is simple. After the ladder is folded, the whole volume of the ladder of the present invention is compact, and thus it can be tied together by generally used elastic ropes (for example, those used on a motorcycle). If it is necessary to expand the ladder, it is only necessary to hold the first section supporting rod (10) or step (15), and the lower supporting rods (10) and steps (15) will drop downwards by gravity alone. The cambered edge (57) on the side of the buckling groove (56) will then be pushed outwards, and when the supporting rod (10) has been expanded to a fixed position, the buckling rod is exactly opposite to the buckling groove (56) of the pivotal block (50). Then by the force applied by the regulating spring (39), it can be buckled into the buckling groove (56). Therefore, the functions of expansion and buckling are achieved, and such operations are very convenient.

Figure 10:
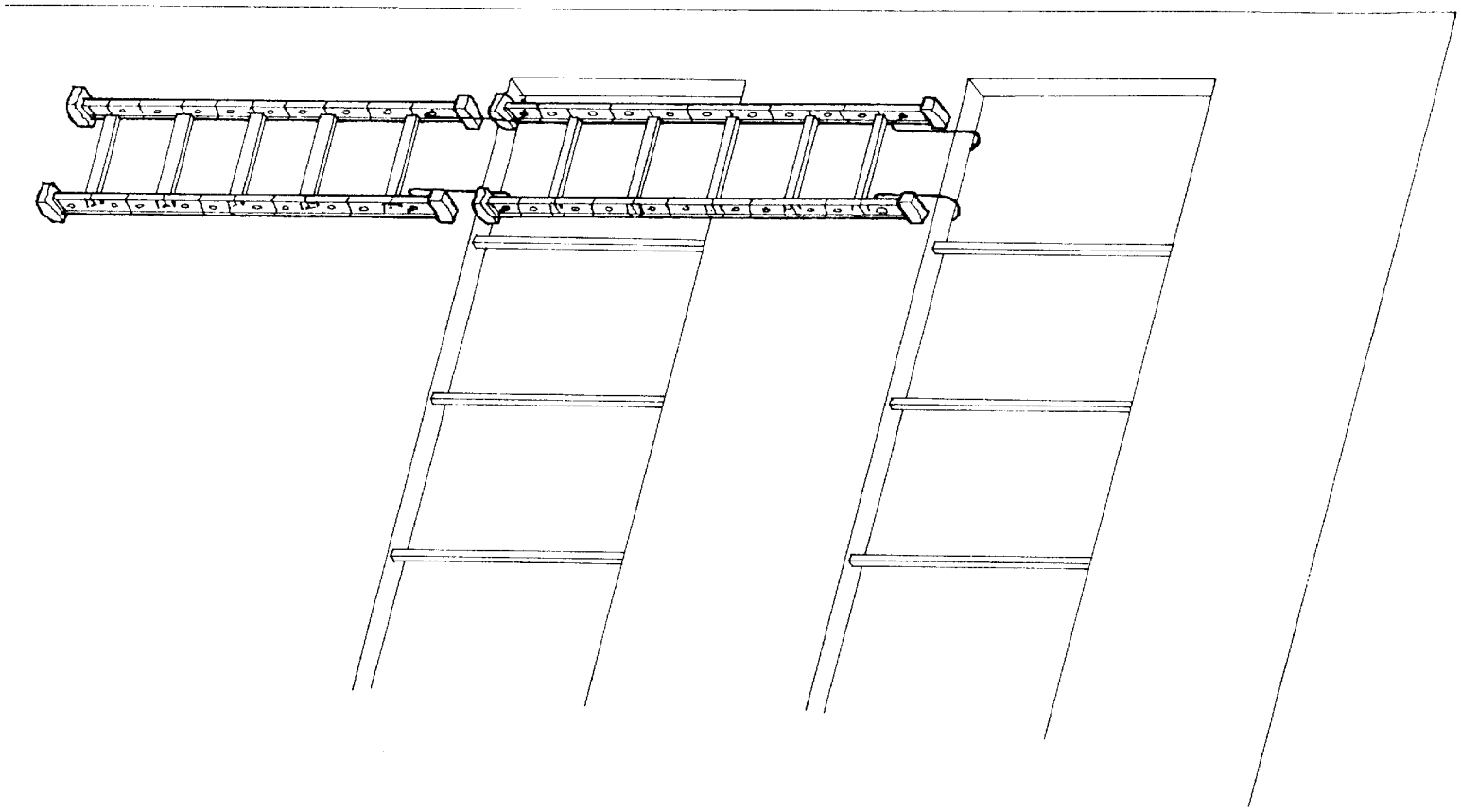
FIG. 10 shows the present invention as used in a building.

In using the present invention, the through hole on the supporting rod (10) can match with the hook (102) shown in FIG. 1, or any other fixing element. As shown in FIG. 10, the present invention may be fixed in a general building. The present invention may also serve as a ladder used in building a house. In the present invention, the pivotal shaft (30) and the control means (20) are matched with the supporting rod (10) and the pedal (15) so as to form a rescue ladder which can be folded completely. Not only is the present invention operated easily, but also after folding, the rescue ladder is portable conveniently. Moreover, the ladder according to the present invention may be expanded to a desired length without expanding the whole ladder.

Although the present invention has been described using specific embodiments, the examples are meant to be illustrative and not restrictive. It is clear that many other variations would be possible without departing from the basic approach, demonstrated in the present invention.

What is claimed is:

1. A foldable and portable ladder comprising a plurality of ladder units, wherein each ladder unit is comprised of two parallel supporting means, a step means provided between the supporting means, and control means provided on either side of the step means posterior to the supporting means, and wherein adjacent ladder units are pivotally connected by pivotal shafts and the control means comprising an upper block, a lower block symmetrical to the upper block, said upper and lower block forming between them a transversal round hole and a long hole, each block having a regulating groove located within and transverse to the round and long holes, a regulating ring is provided within the regulating groove, a buckling rod extending through the regulating ring, and a regulating spring, wherein the control means serves to buckle or unbuckle adjacent ladder units in order to render the ladder rigid or collapsible, respectively.

2. The ladder of claim 1 wherein the supporting means comprise a connecting plate with assembling tubes integrally formed on each side thereof.

3. The ladder of claim 1 wherein a top ladder unit is provided with suspension means to allow the ladder to be suspended from a building.

4. The ladder of claim 1 wherein a bottom ladder unit is provided with footing means to stabilize the ladder.

* * * * *